US010805719B2

(12) United States Patent
Sarvis et al.

(10) Patent No.: US 10,805,719 B2
(45) Date of Patent: Oct. 13, 2020

(54) CONSTANT-DIRECTIVITY TWO WAY WEDGE LOUDSPEAKER SYSTEM

(71) Applicant: PreSonus Audio Electronics, Inc., Baton Rouge, LA (US)

(72) Inventors: Hugh K. Sarvis, Greensboro, NC (US); D. Broadus Keele, Jr., Bloomington, IN (US)

(73) Assignee: PreSonus Audio Electronics, Inc., Baton Rouge, LA (US)

( * ) Notice: Subject to any disclaimer, the term of this patent is extended or adjusted under 35 U.S.C. 154(b) by 0 days.

(21) Appl. No.: 16/138,763

(22) Filed: Sep. 21, 2018

(65) Prior Publication Data

US 2019/0090051 A1 Mar. 21, 2019

Related U.S. Application Data

(60) Provisional application No. 62/561,480, filed on Sep. 21, 2017.

(51) Int. Cl.

| | |
|---|---|
| ***H04R 1/40*** | (2006.01) |
| ***H04R 9/06*** | (2006.01) |
| ***H04R 1/02*** | (2006.01) |
| *H04R 1/26* | (2006.01) |
| *H04R 1/28* | (2006.01) |

(52) U.S. Cl.

CPC ..... *H04R 1/403* (2013.01); *H04R 1/025* (2013.01); *H04R 9/06* (2013.01); *H04R 1/26* (2013.01); *H04R 1/2826* (2013.01)

(58) Field of Classification Search

None

See application file for complete search history.

(56) References Cited

U.S. PATENT DOCUMENTS

| | | | | |
|---|---|---|---|---|
| 4,805,730 | A * | 2/1989 | O'Neill | H04R 1/02 181/145 |
| 6,652,046 | B2 * | 11/2003 | Christner | H04R 1/026 312/111 |
| 2007/0000719 | A1 * | 1/2007 | Bothe | H04R 1/026 181/150 |
| 2007/0228241 | A1 * | 10/2007 | Engebretson | H04R 1/026 248/317 |
| 2008/0192964 | A1 * | 8/2008 | Iwayama | H04R 1/26 381/182 |
| 2011/0305362 | A1 * | 12/2011 | McGhee | H04R 1/02 381/386 |
| 2012/0093347 | A1 | 4/2012 | Adamson et al. | |
| 2013/0240288 | A1 | 9/2013 | Givre | |
| 2017/0264995 | A1 * | 9/2017 | Lippitt | H04R 1/025 |
| 2018/0367875 | A1 * | 12/2018 | Kutil | H04R 1/403 |

FOREIGN PATENT DOCUMENTS

| | | | |
|---|---|---|---|
| DE | 10310033 | A1 | 9/2004 |
| GB | 2482204 | A | 1/2012 |

* cited by examiner

*Primary Examiner* — Paul W Huber

(74) *Attorney, Agent, or Firm* — Leason Ellis LLP

(57) ABSTRACT

A loudspeaker for use in a system of loud speakers comprises a wedge-shaped cabinet having front, back, top, bottom, left and right side faces, a baffle positioned and covering a portion of the front face of the cabinet, a low frequency driver positioned behind the baffle and spaced rearwardly therefrom toward the back face of the cabinet, and a vertically-aligned array including a plurality of high frequency drivers supported by the baffle and shaped, sized and positioned to adjoin with common spacing to a further loudspeaker in the system of loudspeakers.

13 Claims, 15 Drawing Sheets

| Number Boxes and Arc Angle | Directivity vs. Frequency | Power Loss vs. Frequency |
|---|---|---|
| 4<br>80° |  |  |
| 5<br>100° |  |  |
| 6<br>120° |  |  |

CONSTANT-DIRECTIVITY TWO WAY WEDGE LOUDSPEAKER SYSTEM

CROSS-REFERENCE TO RELATED APPLICATIONS

This application claims priority to U.S. Provisional Patent Application No. 62/561,480 filed on Sep. 21, 2017, which is incorporated by reference in its entirety for any purpose.

FIELD OF THE INVENTION

The present invention relates to loudspeaker systems, and in particular relates to a constant-directivity two-way wedge loudspeaker system.

BACKGROUND OF THE INVENTION

The technical demands made on sound stage arrangements at entertainment venues continually increases as performers and promotors compete to achieve higher levels of sound quality and performance. These demands translate directly into challenges for the design of loudspeaker systems. Loudspeakers not only need to be powerful and clear, but they must also meet metrics for beamwidth, directivity and power loss over multiple frequency domains. New designs are needed are to meet these technical demands.

SUMMARY OF THE INVENTION

Disclosed herein is a loudspeaker design that can be used as a stand-alone device, but is also specifically designed to be used in a stacked loudspeaker system. Salient features of the loudspeaker include a wedge shaped cabinet that contains a baffle, a low-frequency driver and an array of high frequency drivers. The baffle covers a portion of the front face of the cabinet. The low frequency driver is located behind the baffle toward the back of the cabinet. In some embodiments, the baffle covers a central portion of the front face of the cabinet, and sound energy emitted from the low-frequency driver travels around the edges of the baffle to exit the loudspeaker. The array of high-frequency drivers is supported on the front face of the baffle. In some embodiments, the drivers within the array have a constant spacing therebetween. The loudspeakers disclosed herein include latch features that enable the speakers to be attached to one another in a stack. In some embodiments, the arrays of high-frequency drivers (of each of the loudspeakers) are designed such that the spacing between the drivers remains constant even across individual loudspeakers, creating a seamless high-frequency driver array across a loudspeaker system. The seamless quality of the high-frequency output improves the overall performance of the loudspeaker system, which has excellent beamwidth, directivity, and power transmission metrics.

In some embodiments, the array of high-frequency drivers is arcuate in shape, and in some implementations the arcuate shape takes the form a segment of the circumference of a circle of a defined angular span. In some embodiments, the array of a single loudspeaker spans an angle of approximately 20 degrees.

DETAILED DESCRIPTION OF CERTAIN EMBODIMENTS OF THE INVENTION

Disclosed herein are embodiments of a two-way constant-directivity wedge loudspeaker system. Embodiments of the loudspeaker system house a single 12" low frequency driver and an array of high frequency drivers in a partial circular arc (e.g., of about 20°) mounted on a solid curved baffle. The high frequency array can be composed of multiple 50.8 mm (2") full-range drivers and can be positioned to cover the low frequency driver. The high frequency array is configured to span the entire vertical height of the speaker. The low frequency driver can a 300 mm (12") 800 W woofer. In some implementations, the baffle covers the low frequency driver. The baffle can be open on either side so that the acoustic output of the low frequency driver and ports can escape to the outside. In some embodiments, an individual speaker system (spanning, for example, a 20° arc) can comprise a wedge cabinet equipped with a four-channel plate amplifier. Two bridged channels can be used to drive the low frequency speaker, and the remaining other channels can be used to drive an eight-driver high frequency array. Individual wedge cabinets can be combined together in multiples to form larger circular-arc arrays of one up to six cabinets. Because the high frequency arrays cover the full height or arc of the speakers, when combined, the arrays on adjacent or abutting cabinets form a seamless unit with no noticeable breaks between the cabinets. In this manner, combined arrays can provide vertical beamwidths in a range of about 15° to about 90°. Suitable amplifier gains can be determined and selected to smooth the polar coverage for each array size.

Figure 1:
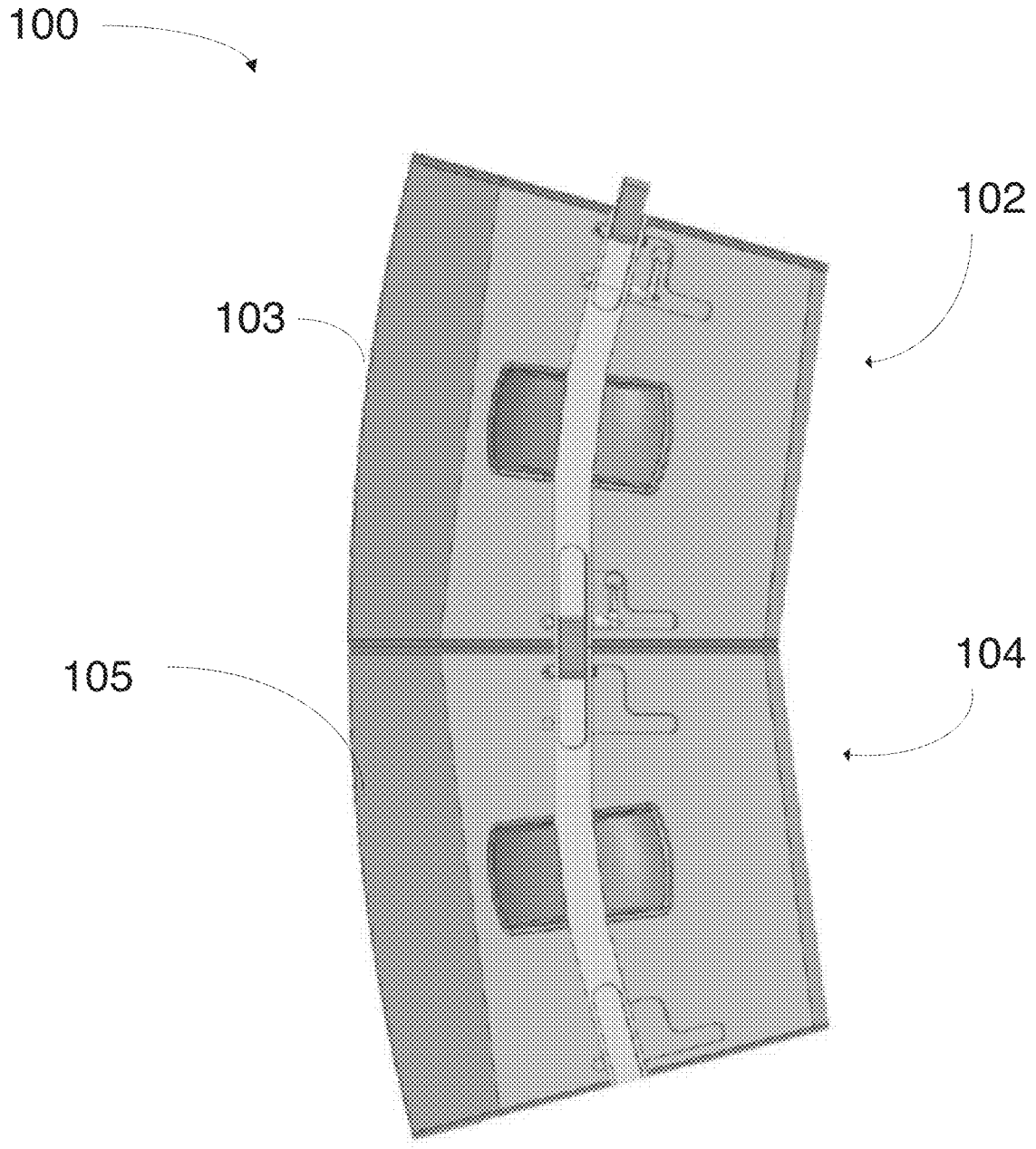
FIG. 1 is a side view of a speaker system including two wedge speaker cabinets according to the present invention.

FIG. 1 is a side view of a speaker system 100 including two wedge speaker cabinets 102, 104 according to an embodiment of the present invention. As can be seen, the respective front surfaces 103, 105 of the cabinets form a short span of a circular arc in a range of about 18° to about 22°, for example, about 20 degrees. When the speakers 102, 104 are positioned on atop the other as in the depicted system 100, the front surfaces combine to span an arc equal to the sum of the angle spanned by each individually, of about 36° to 44°. The cabinets can be made of any suitable materials known in the art, such as birchwood.

Figure 2:
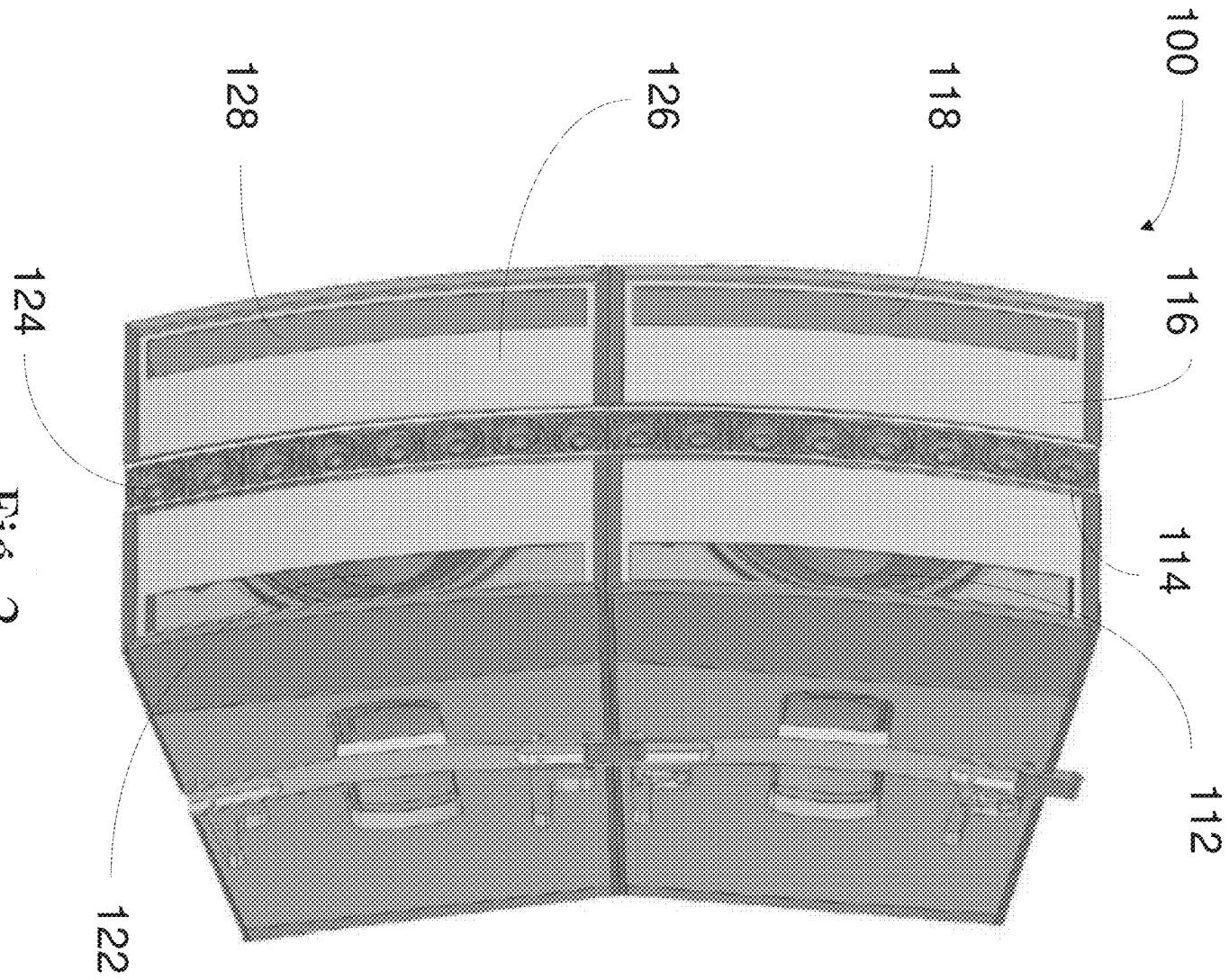
FIG. 2 is a front perspective view of the speaker system shown in FIG. 1.

FIG. 2 is a front perspective view of speaker system 100. As shown, speaker 102 includes a low frequency driver ("LF driver") 112 and a vertically-aligned array of high frequency drivers 114 ("HF array"). In some implementations, the HF array 114 include eight 50.8 mm (2") full-range drivers. The HF array 114 is positioned on a baffle 116 that spans the vertical extent of the wedge speaker cabinet 102, but does not cover the entire horizontal span of the speaker, leaving open sound channels, e.g., 118, on the sides of the baffle for sound to come through from the LF driver. Similarly, wedge speaker cabinet 104 includes LF driver 122, vertically-aligned HF array 124, baffle 126 and open sound channels 128. In this configuration, the acoustic output of the LF drivers 112, 122 flow out and around the HF arrays 114, 124. The system can be crossed over quite at low frequencies, for example, about 400 Hz, which helps avoid any frequency-response anomalies due to positioning the LF drivers behind the HF arrays.

In some alternative embodiments, the baffles 116, 126 can be made of metal and curved. The metal baffle can be solid for roughly 127 mm (5") on either side of the HF array and perforated the rest of the way so that the acoustic output of the LF driver and ports can escape to the outside.

The unique shape and contour of the circular-arc HG array insures that when the wedge speakers are used in multiples, that the HF arrays form a larger seamless and segmented circular-arc array. This insures uniformity of vertical coverage for all the array sizes provided various vertical beamwidths in the range of 15° to 90°. The horizontal beamwidth of all the arrays can be wide, for example, about 150° which can be maintained up to about 10 kHz.

Figure 3:
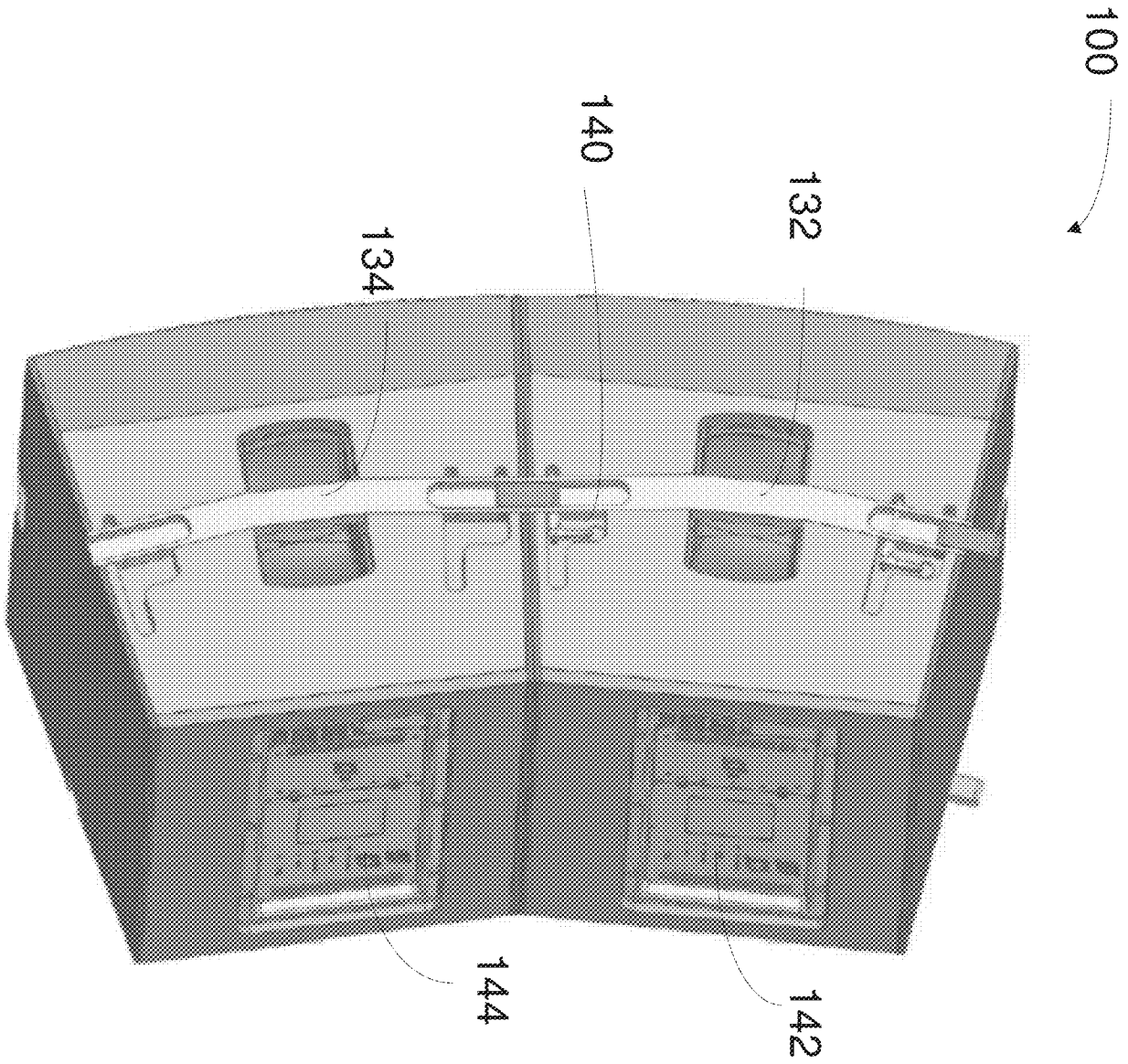
FIG. 3 is a rear perspective view of the speaker system shown in FIG. 1.
Figure 7:
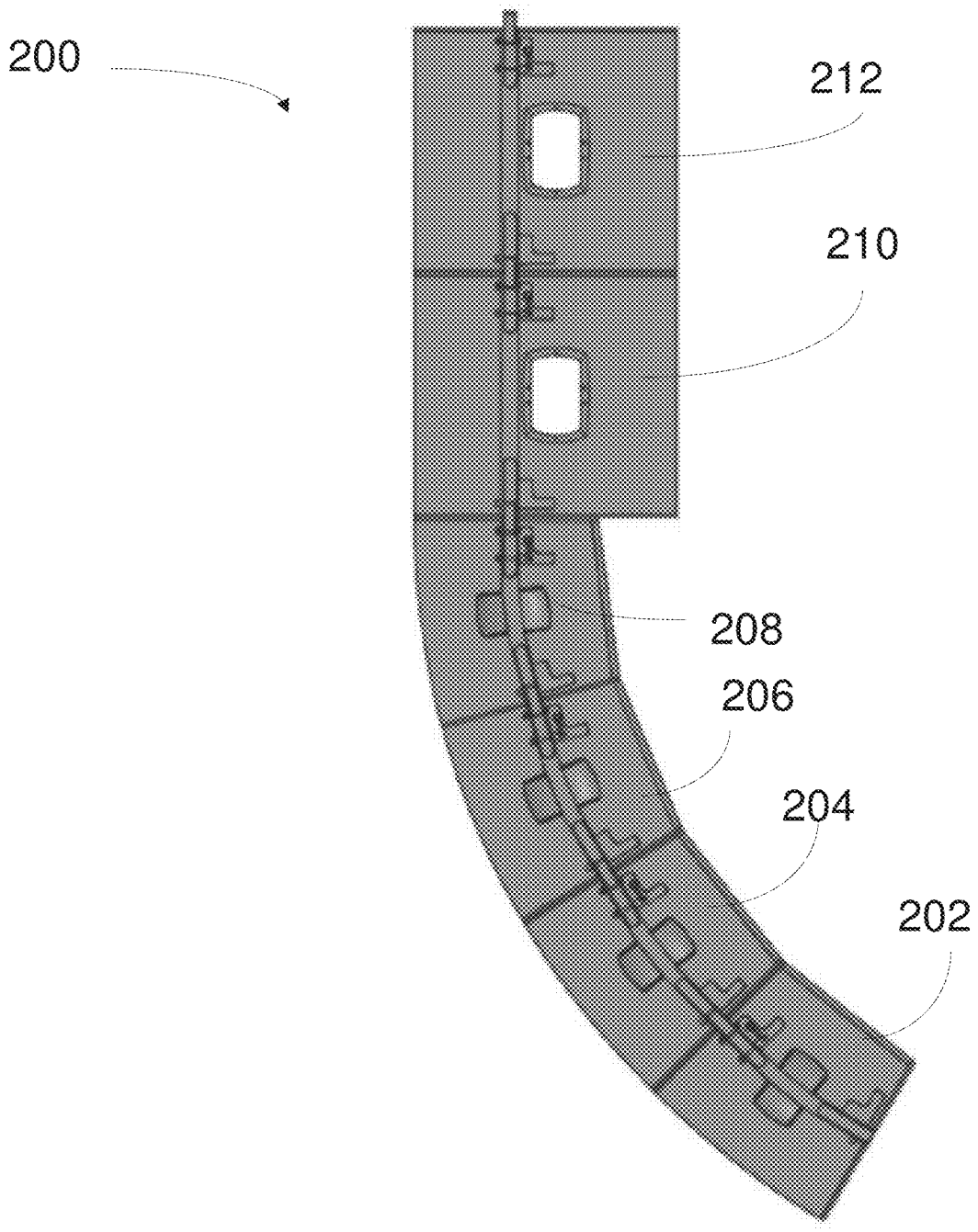
FIG. 7 shows a system 200 including four wedge speaker cabinets according to the present invention 202, 204, 206, 208 coupled to two subwoofer cabinets.
Figure 8:
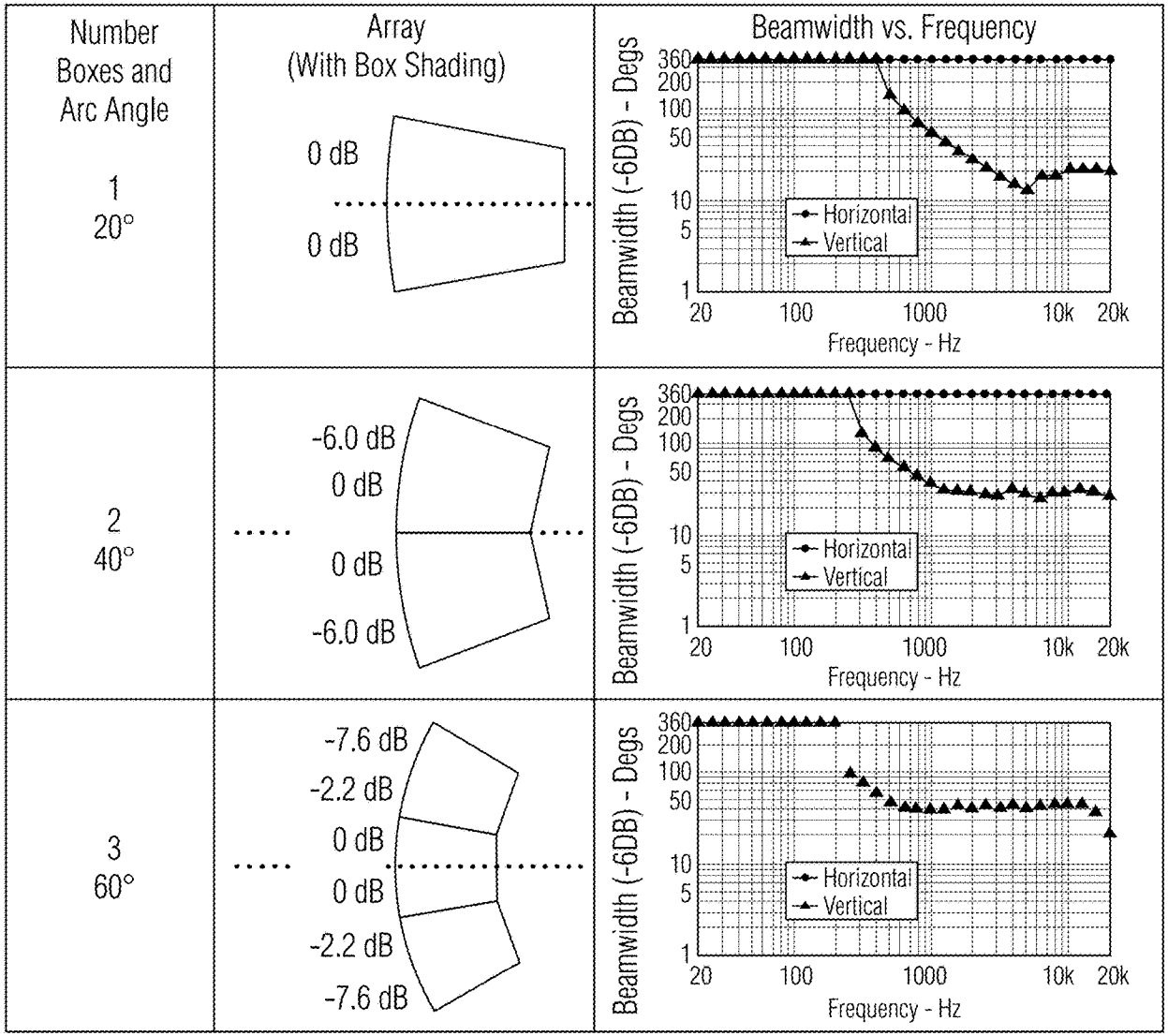
FIG. 8 is a table showing gain values and beamwidth vs. frequency graphs for one, two and three cabinet systems.

FIG. 3 is a rear perspective view of speaker system 100. As shown, one the side of wedge speaker cabinet 102 is a handle 132, and on the side of wedge speaker cabinet 104 is a handle 134. A coupling feature 140, which can be a pin-locked stacking element allow wedge speaker cabinets 102, 104 to be stacked and also attached to subwoofer cabinets for increased LF output below 50 Hz. As an illustrative example, FIG. 7 shows a system 200 in which four wedge speaker 202, 204, 206, 208 are coupled to two subwoofer cabinets 210, 212 using pin-locking elements. The bottom four wedge speaker cabinets 202-208 form a single 80° circular-arc system with 32 HF drivers. Returning again to FIG. 3, amplifiers 152, 154 and related electrical connectors are installed on the back of respective wedge speaker cabinets 102, 104.

In some embodiments, the cabinet dimensions are 0.5 m in height×0.5 m in width×0.4 m in depth (19.85"×19.75"×15"). The loaded weight of this cabinet embodiment can be about 29.5 kg (65 lbs.). The net internal volume is about 0.045 cu m (1.6 cu ft.). The low frequency driver can include a 4" diameter voice coil.

Figure 4:
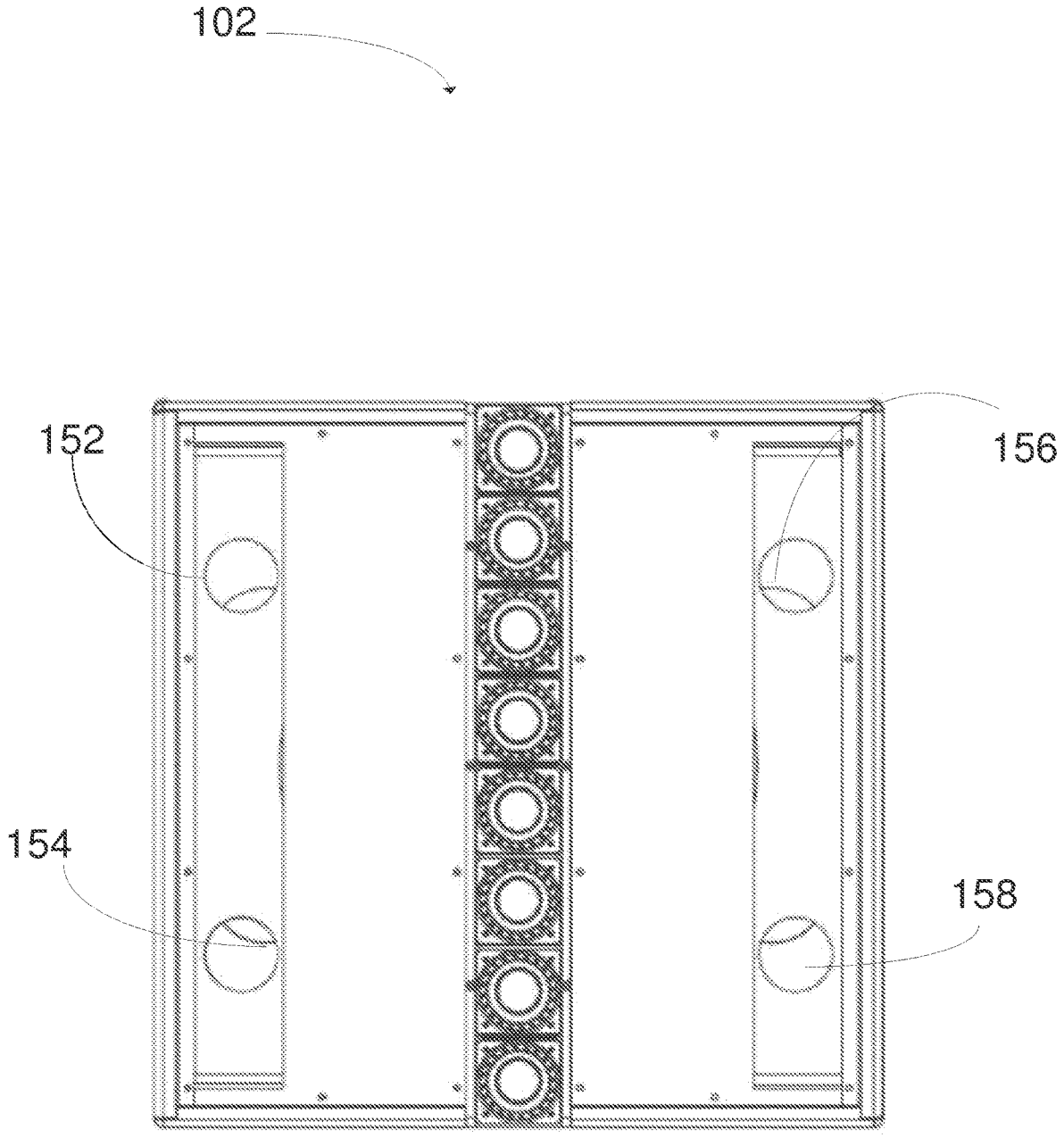
FIG. 4 is a front plan view of a single wedge cabinet according to the present invention.
Figure 5:
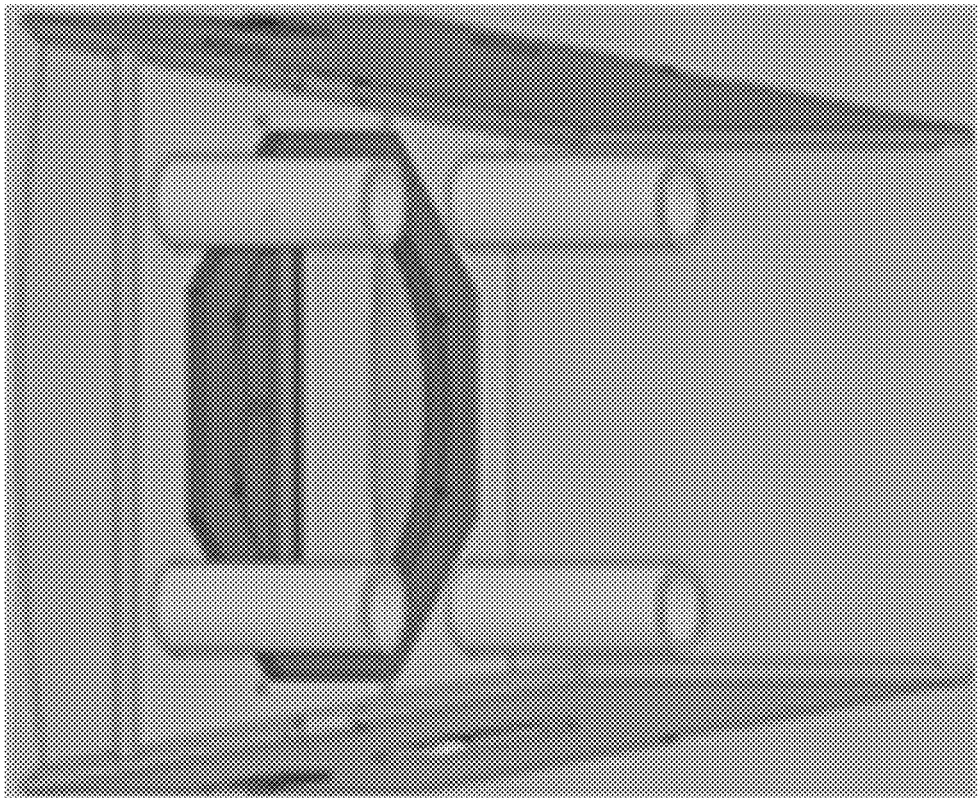
FIG. 5 is a perspective cut-way view of the inside of a wedge speaker cabinet according to the present invention with sides and rear removed.

Each of the wedge speaker cabinets can be vented. FIG. 4 is a front plan view of a single wedge speaker cabinet e.g., 102, according to the present invention. As shown, the cabinet 102 includes four circular vent ports 152, 154, 156, 158 positioned, respectively, at each of the four corners of the cabinet. FIG. 5 is a perspective cut-way view of the inside of a wedge speaker cabinet according to the present invention with sides and rear removed. FIG. 5 shows how the for vent ports 152, 154, 156, 158 as front-mounted cylindrical ports. In some implementations, the vent ports 152-158 can be 50.8 mm (2") in diameter and 228.6 mm (9") long. Locating the ports on the front is advantageous in that it insures that sound issues from the front of the cabinet and that the side or rear ports are not covered up. The vented-cabinet tuning can be relatively low, e.g., 48 Hz, which provides strong acoustic output down to 42 Hz, which is the frequency of the open "E" string of an electric bass guitar. The top and bottom of the cabinet are angled at about 10° from the horizontal to form a 20° arc, while the sides of the cabinet are straight.

Figure 6:
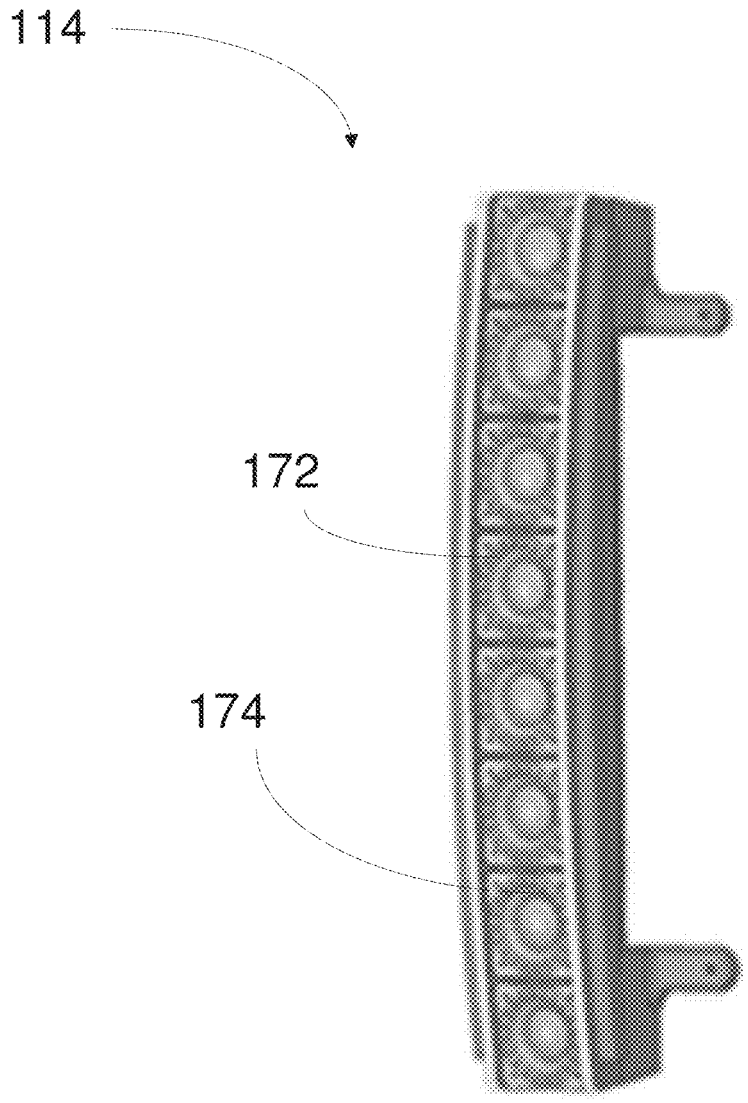
FIG. 6 is a perspective view of a high frequency array that can be suitably used in the wedge speaker cabinets according to the present invention.

FIG. 6 is a perspective view of an exemplary HF array that can is suited for use in the wedge speakers according to the present invention. The exemplary HF array 114 is composed of eight 50.8 mm (2") full-range drivers, e.g., 172, 174 and the total array height about 504.2 mm (19.85"). The drivers of the array are vertically arranged as viewed from the front, but in the perspective view of FIG. 5, it can be seen that the drivers are arranged in a partial circular-arc angle of about 20°, matching the wedge angle of the speaker cabinet. The angular span of the HF array is selected to maintains constant center-to-center spacing among all the HF drivers. When speaker cabinets are stacked, the array effectively becomes larger with seamless transitions between each single cabinet and the next. The HF array and cabinet wedge angle is selected so that that a single cabinet speaker has a sound beamwidth of about 15° since the beamwidth tends to be approximately 75 percent of the circular arc angle of the wedge cabinet.

Each of amplifiers e.g., 152, 154 used in the wedge speakers can comprises built-in digital signal processors (DSPs) with four channels combined with a 500 W per channel (4 Ohm load) mounted plate amplifier. Two channels are series-bridged to drive the LF driver (e.g., 8 Ohms) at 1000 W, while the other two 500 W channels drive the top and bottom four drivers of the HF array respectively. The high power of the built-in amplifier enables reproduction of very high peak SPLs. The DSP capabilities can include FIR, IIR, parametric EQ, all pass, shelf, high- and low-pass filters, delay, and limiting, etc. Complete networking control capabilities can be included with Ethernet or Dante.

Figure 9:
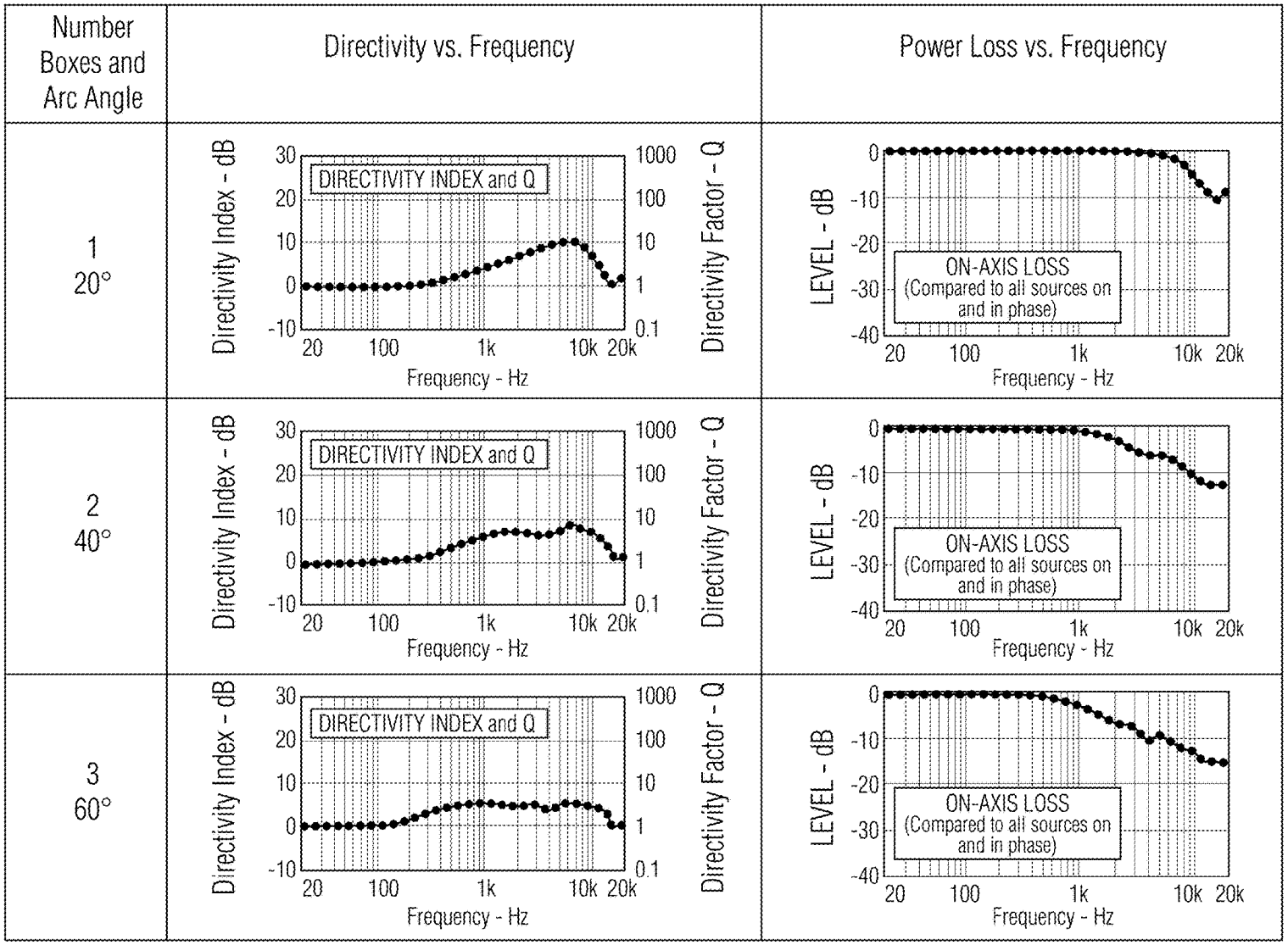
FIG. 9 is a table showing directivity vs. frequency and power loss vs. frequency graphs for one, two and three cabinet systems.
Figure 10:
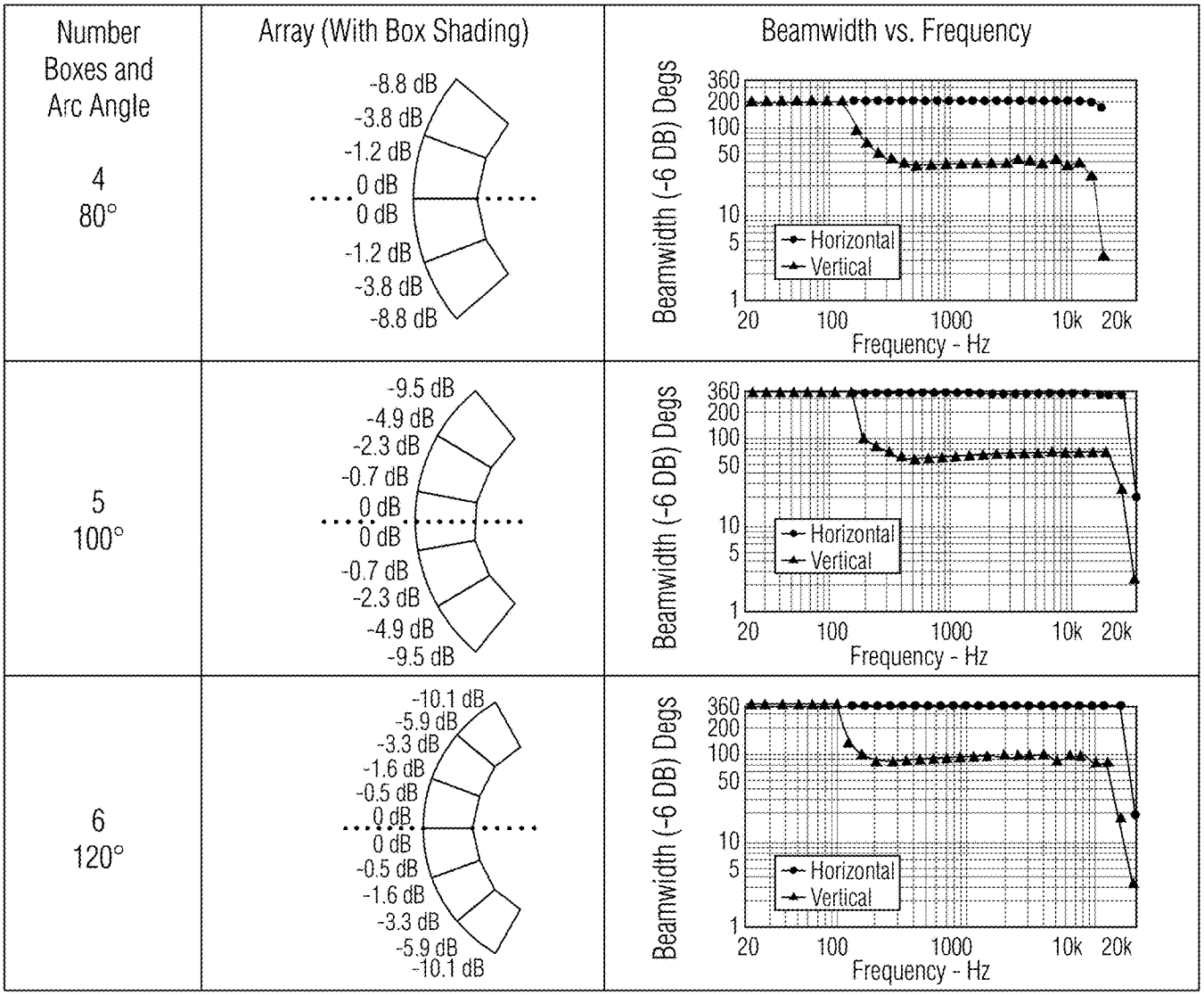
FIG. 10 is a table showing gain values and beamwidth vs. frequency graphs for four, five and six cabinet systems.
Figure 11:
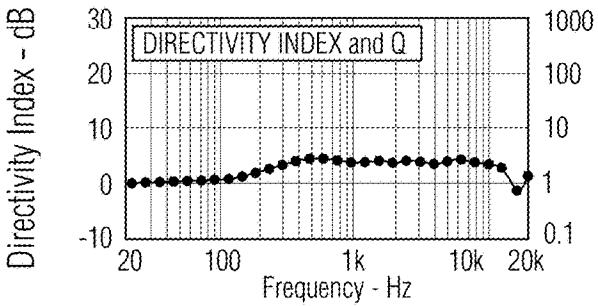
FIG. 11 is a table showing directivity vs. frequency and power loss vs. frequency graphs for four, five and six cabinet systems.
Figure 11:
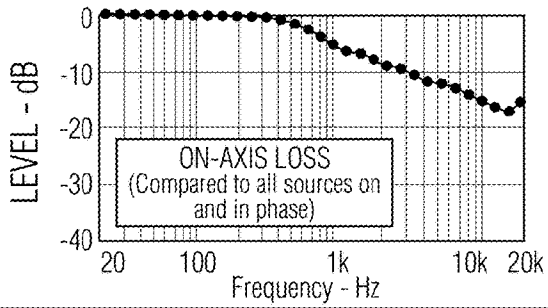
Figure 11:
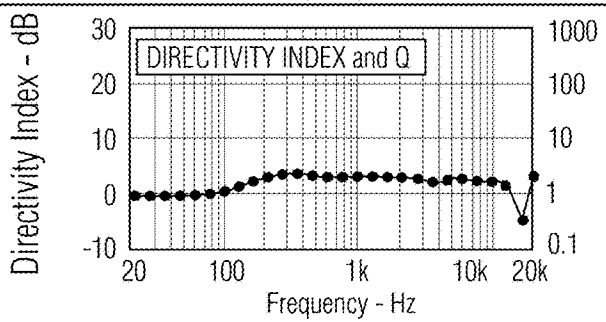
Figure 11:
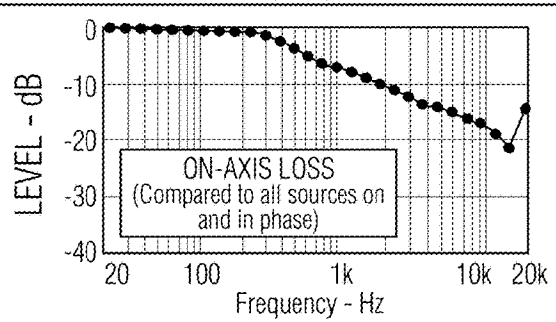
Figure 11:
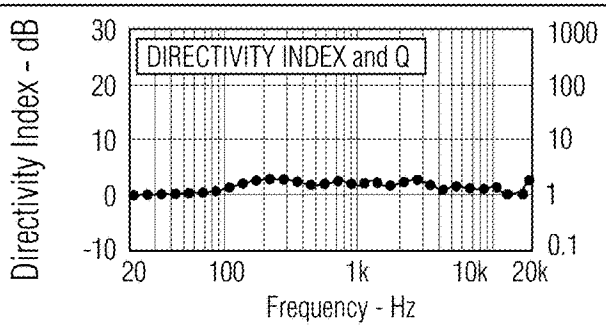
Figure 11:
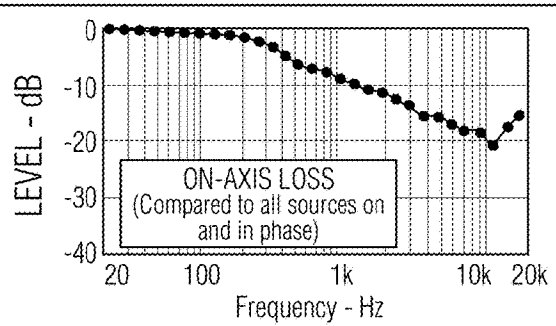
Figure 12:
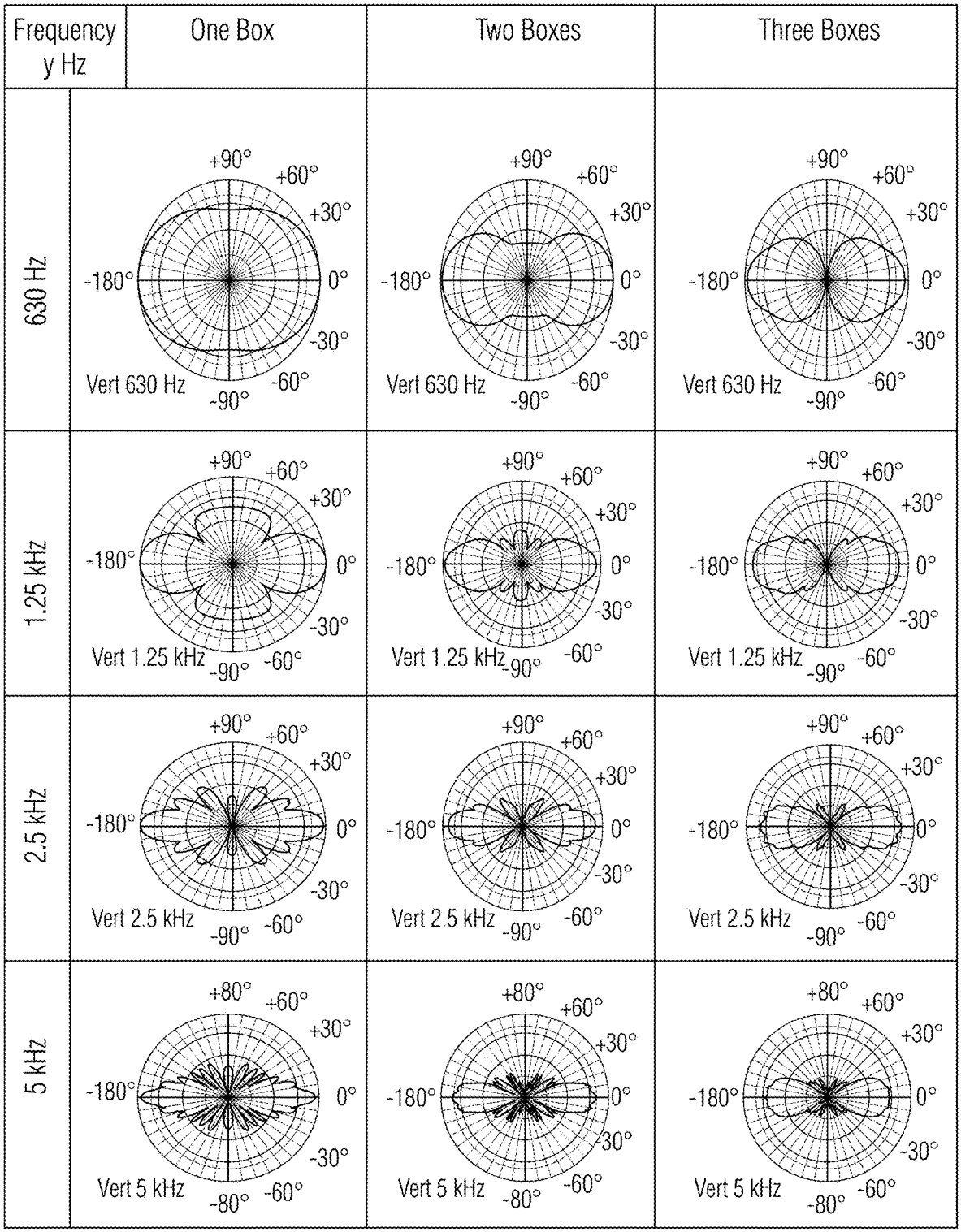
FIG. 12 is a table showing polar maps by frequency of 630 Hz, 1.25 kHz, 2.5 kHz, 5 kHz for one, two and three cabinet systems.
Figure 13:
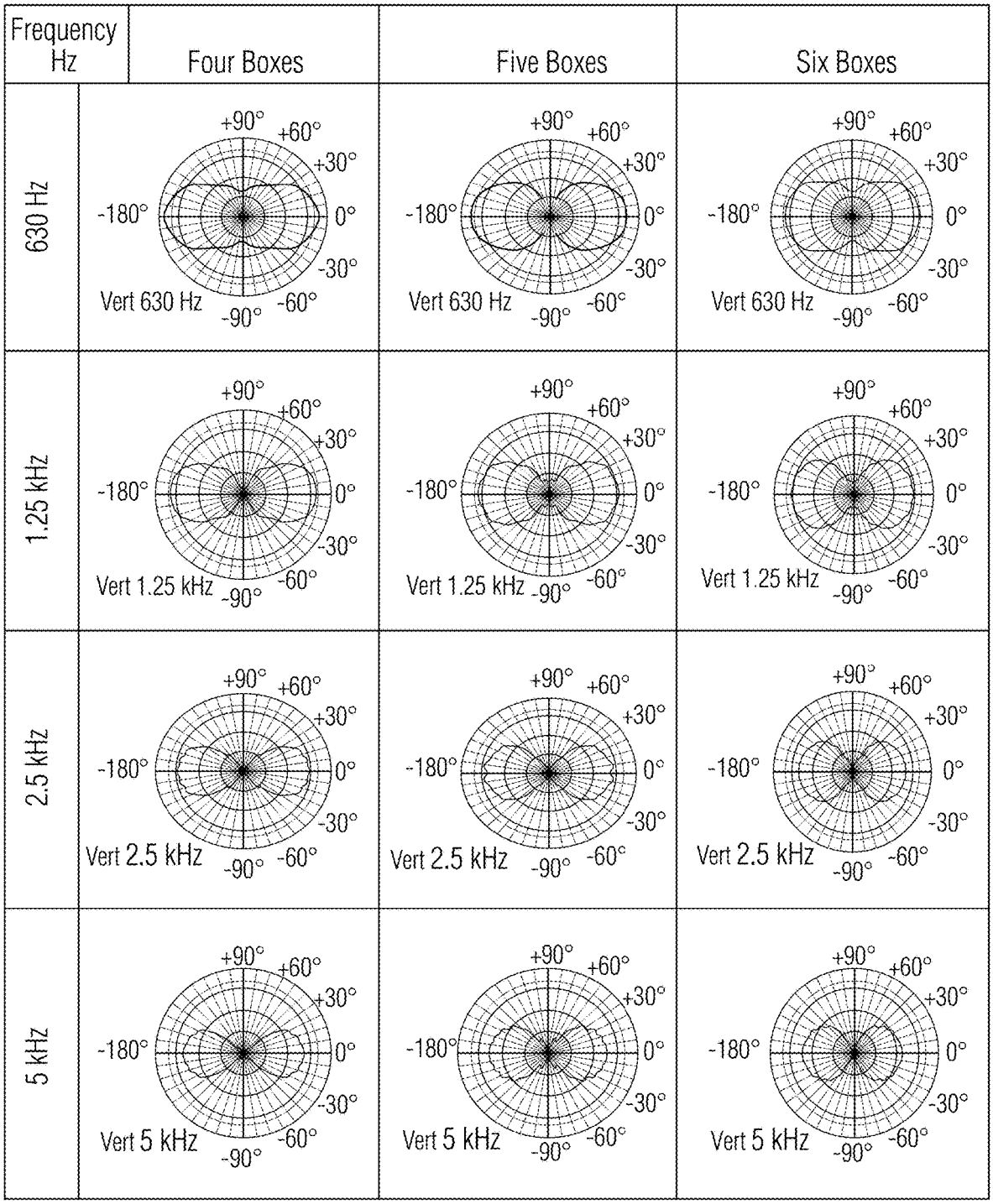
FIG. 13 is a table showing polar maps by frequency of 630 Hz, 1.25 kHz, 2.5 kHz, 5 kHz for four, five and six cabinet systems.
Figure 14:
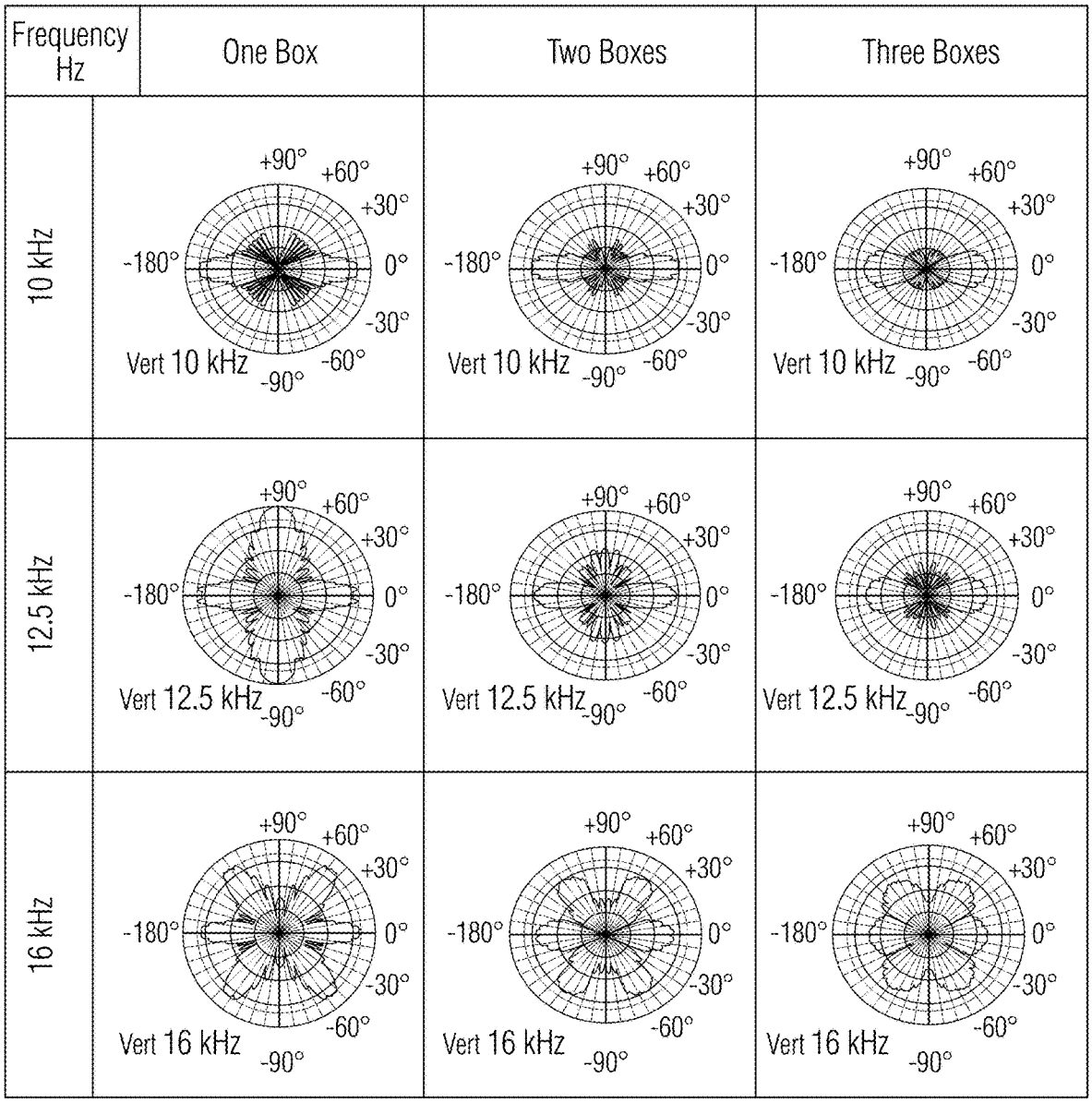
FIG. 14 is a table showing polar maps by frequency of 10 kHz, 12.5 kHz, 16 kHz for one, two and three cabinet systems.
Figure 15:
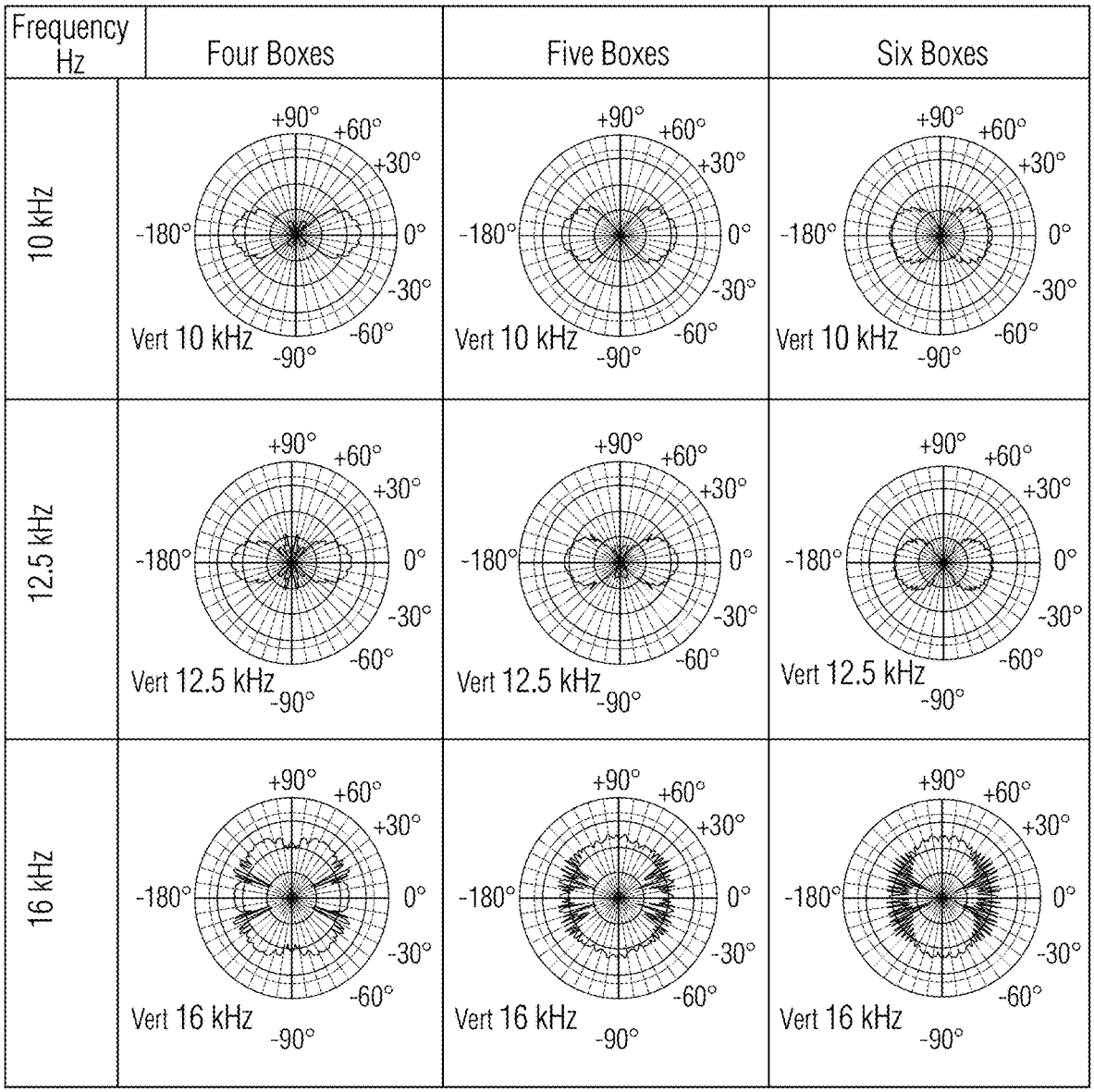
FIG. 15 is a table showing polar maps by frequency of 10 kHz, 12.5 kHz, 16 kHz for four, five and six cabinet systems.

The gains or weights of the HF driver amplifiers are selected to maintain smooth and consistent polars for each of the array sizes. Gains are symmetrical up-down with the highest values in the center and the lowest values on the ends. Each cabinet has two gain values associated with the two amp channels powering the lower and upper tweeters in the array respectively. In one implementation, the following gain values were set for each array size: One cabinet: 0, 0 dB; two cabinets: −6, 0, 0, −6 dB; three cabinets: −7.6, −2.2, 0, 0, −2.2, −7.6 dB; four cabinets: −8.8, −3.8, −1.2, 0, 0, −1.2, −3.8, −8.8 dB; Five cabinets: −9.5, −4.9, −2.3, −0.7, 0, 0, −0.7, −2.3, −4.9, −9.5 dB; and Six cabinets: −10.1, −5.9, −3.3, −1.6, −0.5, 0, 0, −0.5, −1.6, −3.3, −5.9, −10.1 dB. This amplitude tapering or shading goes a long way towards smoothing and minimizing side lobes in the polar response of loudspeaker arrays. FIG. 9 shows simulation results show that the the seamless joining of HF drivers among the wedge cabinet in a system create a unified sound experience, but also that, as the number of cabinets joined in a system increases, the shading characteristics improve, and become less granular, and approach continuous Legendre shading to a higher degree. Accordingly, it has been found that the wedge speakers according to the present invention that include HF array arcs that seamless combine with the drivers of adjacent speakers, improve in terms of power and acoustic characteristics as more cabinet speakers are added, up to a frequency bound of approximately 12.5 kHz.

FIG. 8-14 show results of simulations for one, two, three, four, five and six cabinet systems. The simulation results include gain settings, beamwidth vs. frequency response, directivity index vs. frequency, and level (dB) vs. frequency. The simulation results also show polar maps by frequency. The results highlight The experimental simulations show that a very-practical constant-coverage/directivity wide-range wedge loudspeaker system can be designed and constructed that when used to form larger arrays can provide various well-behaved wider coverage patterns with extremely uniform vertical and horizontal coverage. Each wedge speaker cabinet is in effect a coaxial design providing a very well-controlled vertical pattern with a very-wide horizontal pattern. The overall system provides broadband 45 Hz to 15 kHz response and is very versatile due to its built-in plate amplifier that is controllable via Dante or Ethernet. Side-mounted pin-loaded hardware is included for ease of stacking.

It is to be understood that any structural and functional details disclosed herein are not to be interpreted as limiting the systems and methods, but rather are provided as a representative embodiment and/or arrangement for teaching one skilled in the art one or more ways to implement the methods.

It is to be further understood that like numerals in the drawings represent like elements through the several figures, and that not all components and/or steps described and illustrated with reference to the figures are required for all embodiments or arrangements The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing, and are not to be construed as limiting. However, it is recognized these terms could be used with reference to a viewer. Accordingly, no limitations are implied or to be inferred.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker for use in a system of loudspeakers, the loudspeaker comprising:

a wedge-shaped cabinet having front, back, top, bottom, left and right side faces;

a baffle positioned and covering a portion of the front face of the cabinet;

a low frequency driver positioned behind the baffle and spaced rearwardly therefrom toward the back face of the cabinet; and a vertically-aligned array including a plurality of high frequency drivers supported by the baffle having a common spacing within the array, the array having a top that is flush with a top edge of the top face of the cabinet and having a bottom that is flush with a bottom edge of the bottom face of the cabinet.

2. The loudspeaker of claim 1, further comprising:

a first latch positioned at a top of at least one of the left and right side faces and extending beyond a top face of the of the cabinet; and a first groove positioned at a bottom of at least one the left and right side faces.

3. The loudspeaker of claim 1, wherein the vertically-aligned array is arranged in an arc.

4. The loudspeaker of claim 3, wherein the arc is a segment of a circle.

5. The loudspeaker of claim 4, wherein the arc spans an angle of about 20 degrees.

6. The loudspeaker of claim 1, wherein the array includes 8 (eight) high-frequency drivers.

7. A loudspeaker system comprising at least first and second loudspeakers as recited in claim 2, wherein the first latch of the first loudspeaker is coupled to the first groove of the second loudspeaker, so as to form a stack between the first and second loudspeakers.

8. A loudspeaker system comprising:

a first loudspeaker and a second loudspeaker, each of the first and second loudspeakers including:

a wedge-shaped cabinet having front, back, top, bottom, left and right side faces;

a baffle positioned and covering a portion of the front face of the cabinet;

a low frequency driver positioned behind the baffle and spaced rearwardly therefrom toward the back face of the cabinet;

a vertically-aligned array including a plurality of high frequency drivers supported by the baffle and shaped, sized and positioned to adjoin with common spacing to a further loudspeaker in the system of loudspeakers;

a first latch positioned at a top of at least one of the left and right side faces and extending beyond a top face of the of the cabinet; and a first groove positioned at a bottom of at least one the left and right side faces;

wherein the first latch of the first loudspeaker is coupled to the first groove of the second loudspeaker, so as to form a stack between the first and second loudspeakers, and wherein the arrays of the first and second loudspeakers couple seamlessly to cover a span with equal spacing between the high frequency drivers across the first and second loudspeakers.

9. The loudspeaker system of claim 8, wherein the vertically-aligned arrays of the first and second loudspeakers are arranged in an arc.

10. The loudspeaker system of claim 9, wherein the arc is a segment of a circle.

11. The loudspeaker system of claim 10, wherein the arc spans an angle of about 20 degrees.

12. The loudspeaker system of claim 8, wherein the vertically-aligned arrays of the first and second loudspeakers each include eight high-frequency drivers.

13. A loudspeaker system, comprising:

a first loudspeaker and a second loudspeaker engageable to each other, each of the first and second loudspeakers including:

a wedge-shaped cabinet having front, back, top, bottom, left and right side faces;

a baffle positioned and covering a portion of the front face of the cabinet spanning a vertical extent of the wedge-shaped cabinet between the top and bottom faces;

a low frequency driver positioned behind the baffle and spaced rearwardly therefrom toward the back face of the cabinet; and a vertically-aligned array including a plurality of high frequency drivers supported by the baffle and shaped, sized and positioned with a common spacing within the baffle;

wherein the vertically-aligned arrays of the first and second loudspeakers define a continuous, commonly-spaced arrangement of drivers when the first and second loudspeakers speakers are engaged.

* * * * *